US011357287B1

(12) United States Patent
Patron et al.

(10) Patent No.: US 11,357,287 B1
(45) Date of Patent: Jun. 14, 2022

(54) HEEL PROTECTION DEVICE

(71) Applicants: Iliana Maria Patron, Miami, FL (US); Edwin Ernesto Luna, Miami, FL (US)

(72) Inventors: Iliana Maria Patron, Miami, FL (US); Edwin Ernesto Luna, Miami, FL (US)

( * ) Notice: Subject to any disclaimer, the term of this patent is extended or adjusted under 35 U.S.C. 154(b) by 77 days.

(21) Appl. No.: 16/946,569

(22) Filed: Jun. 26, 2020

Related U.S. Application Data

(60) Provisional application No. 62/877,392, filed on Jul. 23, 2019.

(51) Int. Cl.
*A43B 21/42* (2006.01)

(52) U.S. Cl.
CPC ..... *A43B 21/42* (2013.01)

(58) Field of Classification Search
CPC ..... A43B 21/22; A43B 21/42; A43B 21/437; A43B 21/24; A43B 21/00; A43C 13/00; A43C 13/02; A43C 13/12; Y10T 24/394; Y10T 24/3944; F16B 2/185
USPC ..... 36/72 b, 73
See application file for complete search history.

(56) References Cited

U.S. PATENT DOCUMENTS 201,035 A * 3/1878 Moore ..... F16G 11/10 24/134 R
230,435 A * 7/1880 Pitney ..... F16G 11/10 24/134 R
334,878 A * 1/1886 Manners ..... B63B 21/08 114/199
418,413 A * 12/1889 Johns ..... F16G 11/10 24/134 R
526,830 A * 10/1894 Dulje ..... A43C 7/00 24/712.5
1,372,853 A * 3/1921 Wellen ..... A62B 1/14 188/65.2
1,964,049 A * 6/1934 Giannini ..... A43C 13/02 36/72 B
3,150,453 A * 9/1964 Tilden ..... A43C 13/00 36/72 B
6,341,742 B1 * 1/2002 Rosenthal ..... F16G 11/12 242/388.2
2008/0196279 A1 * 8/2008 Epping ..... A43C 13/00 36/72 B
2008/0216363 A1 * 9/2008 Alexander ..... A43C 13/00 36/72 B
2011/0154623 A1 * 6/2011 Schmidt ..... H02G 3/32 24/457

FOREIGN PATENT DOCUMENTS

GB 2204475 * 11/1988

* cited by examiner

*Primary Examiner* — Ted Kavanaugh
(74) *Attorney, Agent, or Firm* — Olav M. Underdal; IDP Patent Services

(57) ABSTRACT

A heel protection device for protecting from damage a portion of a heel of a shoe not intended for contact with a walking surface. The device includes a housing including an internal receptacle to accept the heel. The device includes an outer portion and sides to protect the material of the heel from damage. The device housing also includes a latching portion, which includes a lever with an asymmetric head which may be moved from an "open" position, in which the heel can be accepted into the receptacle and positioned on the heel, to a "secured" position in which the device is secured in a position covering a portion of the heel by friction elements.

14 Claims, 6 Drawing Sheets

HEEL PROTECTION DEVICE

TECHNICAL FIELD

The present disclosure relates to a heel protector. In particular, the present disclosure relates to a device for protecting from damage a portion of a heel of a shoe not intended for contact with a walking surface.

BACKGROUND

High-heel shoes, such as the styles shown in FIG. 1, may come in a variety of heel heights and styles. A person may own a number of high-heel shoes in various styles, colors, and/or heel heights for different types of social or business events. As such, they may represent a considerable investment, and as a relatively delicate style of shoe, require a certain amount of care. The heel of the shoe may be especially susceptible to scuffing, scratches, and other blemishes due to, for example, a misstep on stairs or on uneven or cracked walking surfaces. The heels may also be damaged while resting the heel against a surface, such as the floorboard of a car while driving.

Accordingly, it would be advantageous to provide a convenient, effective, and aesthetic way to protect a heel of a shoe from potential damage during use.

SUMMARY

A heel protection device is disclosed. The heel protection device includes an outer portion with a curved shape to substantially match the shape of a variety of high-heeled shoes, a latching portion opposing the outer portion, and two sides connecting the outer portion and the latching portion. An inner receptacle for the heel of a high-heeled shoe is formed from the inner surfaces of the outer portion, the sides, and the latching portion The device includes a lever connected along the horizontal axis of the latching portion, and includes an arm and an asymmetrical head including friction elements, e.g., teeth-shaped elements, to engage with the material of the heel. The user may position the device on the heel when the arm is disengaged. Once the user has determined the appropriate position for the device, the user may engage the latch by pulling the lever down (or up, depending on the orientation of the device), thereby engaging the friction elements into the material of the heel to provide a secure connection. Once engaged, the device is secured to the heel, and provides protection against accidental damage.

DETAILED DESCRIPTION

Figure 1:
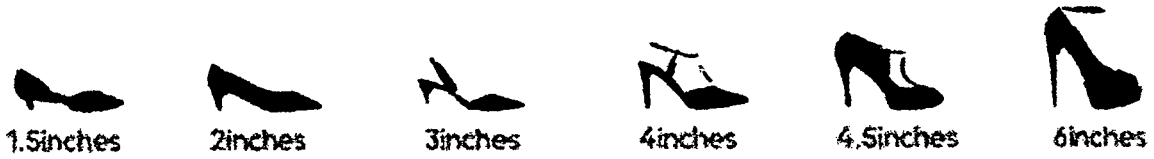
FIG. 1 (Prior Art)
FIG. 1 shows a variety of available styles and heights of heel for high-heel shoes.
Figure 2:
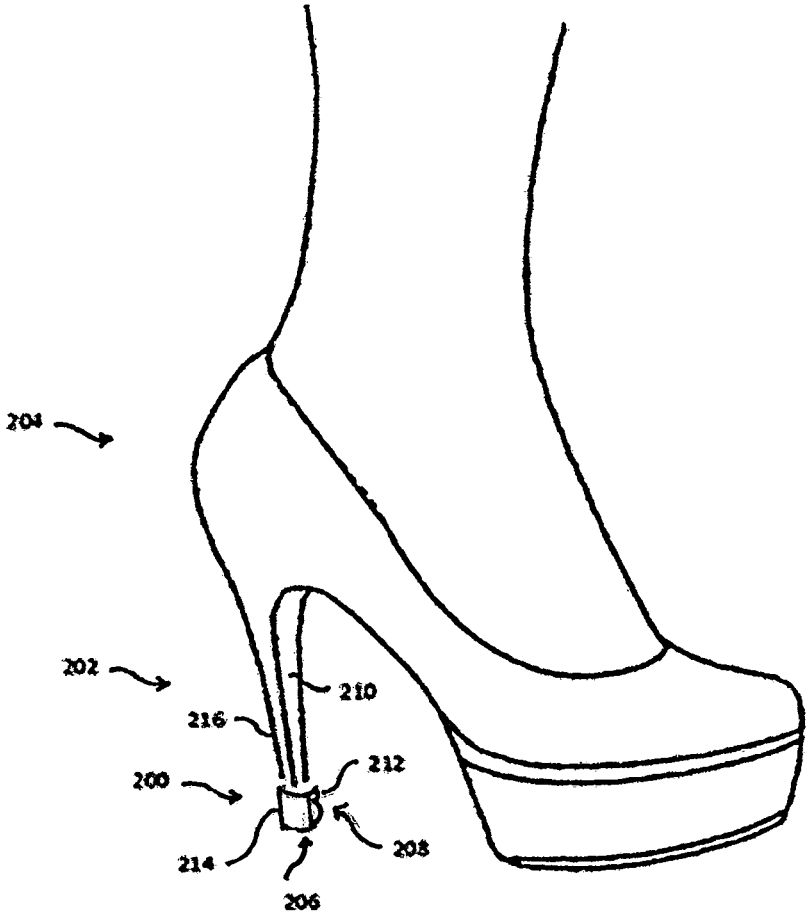
FIG. 2 is a perspective view of a heel protection device according to an embodiment.

FIG. 2 shows a heel protection device 200 according to an embodiment. The device 200 is secured to the heel 202 of a high-heel shoe 204 above the top piece 206 of the heel. The device 202 includes a latching portion 208 positioned on the inner side (breast) 210 of the heel, and may include a lever 212 to enable the user to secure the device to the heel. The latching portion 208 may have a generally flat shape to match the shape of the breast 210 of the heel.

Figure 3:
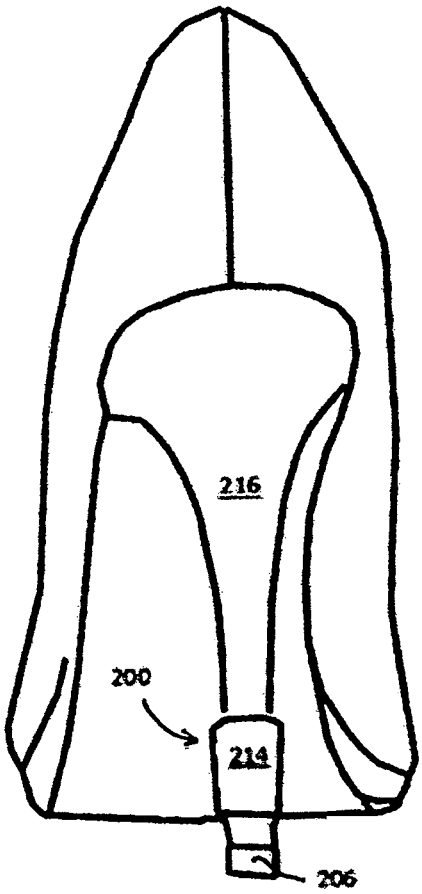
FIG. 3 is a rear view of the heel protection device of FIG. 2.

The device includes an outer portion 214 positioned over a portion of the outer side 216 of the heel, which may provide protection for that area of the heel from damage. As shown in FIG. 3, the outer portion 214 may include a smooth, solid surface, unlike the latching portion 208, for aesthetic purposes. The outer portion 214 may have a curved shape to generally match the shape of the outer side 216 of the heel. In an embodiment, the outer portion 214 has a height of between 15-20 mm, but other ranges may be used depending on the desired length of the heel to be protected.

Figure 4:
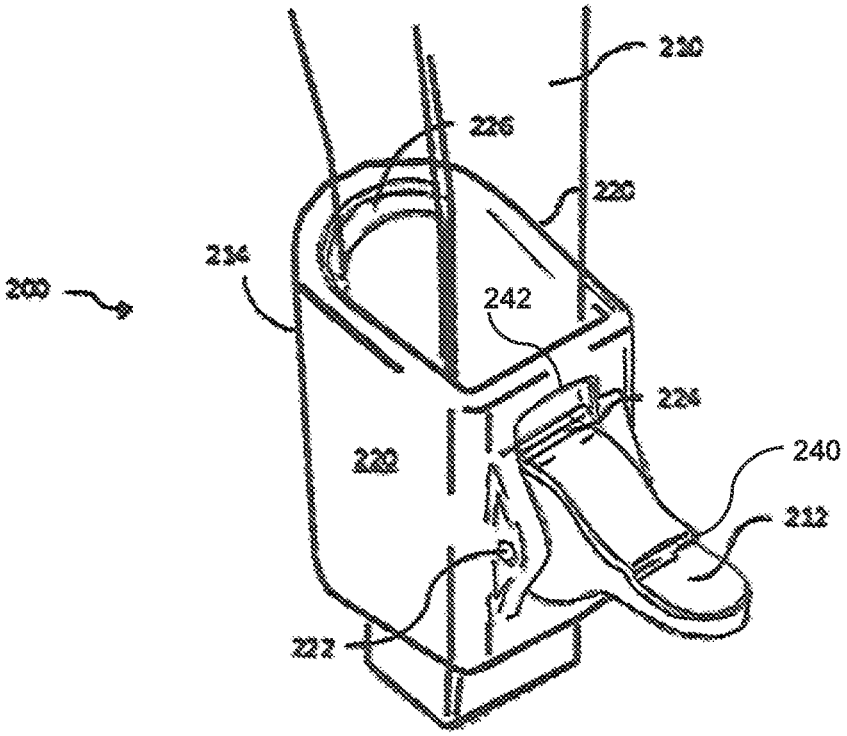
FIG. 4 shows a more detailed view of the heel protection device of FIG. 2.
Figure 7A:
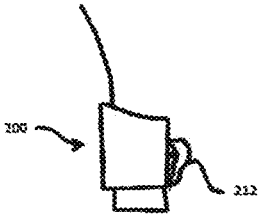
FIG. 7A shows a side view of a heel protection device according to an embodiment in an "open" position.

FIG. 4 shows a more detailed view of an embodiment of the device 200. The lever 212 in the latching portion 208 is in a "positioning" position in which a portion of the lever is in contact with the material of the breast 210 of the heel in order to approximate a final position, but is not secured to the heel. In addition to the latching portion 208 and outer portion 214, the device housing includes sides 220. The lever 212 is attached to the housing by a hinge 222, which may be, e.g., a metal rod passing through the body of the lever. The lever may include ridges, or "teeth", 224 for contacting the material of the breast 210 of the heel, creating a friction grip when the lever is in a latched or "secured" position, as shown in FIG. 7C.

The material of the device housing, including latching portion 208, outer portion 214, and sides 220, may be made of a relatively hard material to provide protection to the heel. The inner surfaces of the device housing form an inner, receptacle area to receive the heel.

In an embodiment, the device housing may be a constructed from a hard plastic material, which may be vacuum metallized to provide a variety of metallic colors. However, many other materials may be used, for example, metal, wood, etc. Various construction methods for the different components of the device 200 may be utilized, depending on the material used, cost, convenience, etc. These may include, for example, molding, pressing, 3-D printing, CNC (computer numerical control) milling, etc., and the use of various fastening and joining technologies, including, for example, metal or plastic welding, adhesives, the use of various types of mechanical fasteners, etc.

To protect the heel from the hard edges and inner surfaces of the device housing, a lining 226 made of a relatively soft material may be provided on the inner walls of the outer portion 214. In an embodiment, the lining 226 may also be extended along at least a portion of the walls 220. The material of the lining may be, for example, rubber, silicone, a polymer, fabric, a cellulose and/or polymer material, cork, etc.

Figure 5:
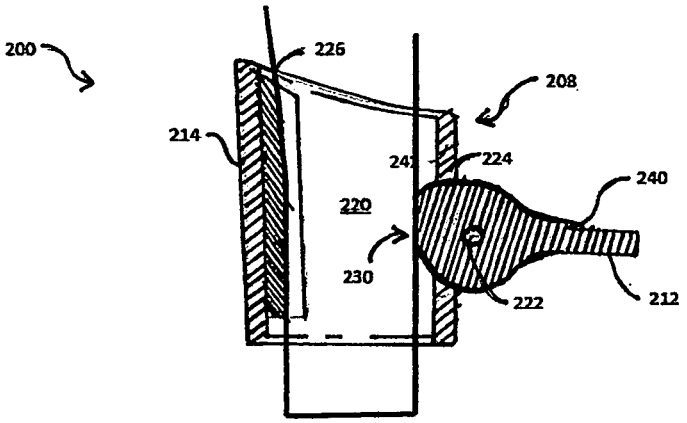
FIG. 5 is a sectional view of a heel protection device according to an embodiment in a "positioning" position.
Figure 7B:
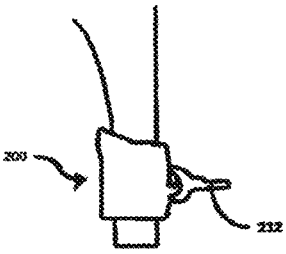
FIG. 7B shows a side view of a heel protection device according to an embodiment in a "positioning" position.
Figure 7C:
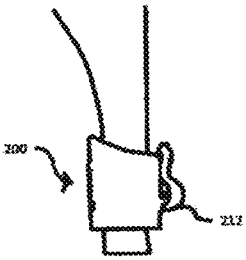
FIG. 7C shows a side view of a heel protection device according to an embodiment in a "secured" position.

FIG. 5 is a cross-sectional view of an embodiment of the device 200 in the "positioning" position, also shown in side view in FIG. 7B. The lever 212 may have an asymmetric head 230 that has a shape such that when the lever 212 is "down", or in an "open" position, as shown in a side view in FIG. 7A, the lever head 230 does not, or barely, contacts the material of the heel such that the device 200 can be freely moved onto and along the heel. The user can set the device 200 to a desired position on the heel by moving the lever up until the lever head 230 makes a solid connection with the material of the heel.

Figure 6:
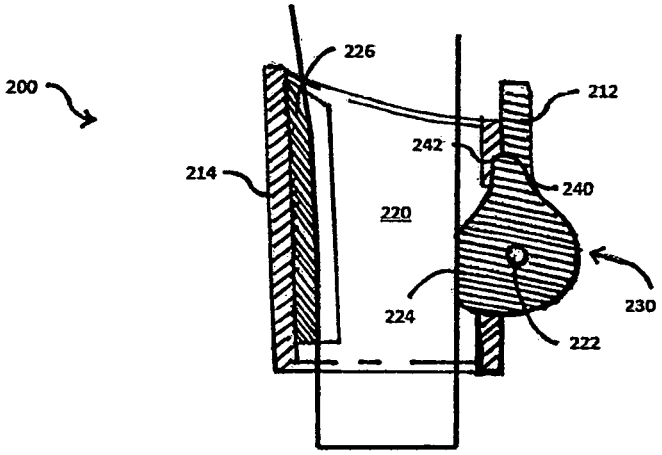
FIG. 6 is a section view of the heel protection device shown in FIG. 5 in a "secured" position.

As shown in FIG. 6, when the lever 212 is moved fully up into a "secured" position, the teeth 224 engage with the material of the heel, forming a friction grip to hold the device 200 firmly in place without the user having to continue to place pressure on the lever. The lever 212 may include a locking portion 240 which mates with a locking portion 242 in the latching portion 208 of the device housing when the lever 212 is moved into the "secured" position. The locking portions 240 and 242 may be positioned on the lever 212 and latching portion 208, respectively, such that the lever 212 snaps into place when moved into the "secured" position, thereby preventing the lever 212 from moving on its own. The user can simply unsnap the lever when desiring to remove the device 200 from the heel of the shoe.

As the lever 212 is moved fully into the "secured" position, it will rise slightly. This is due to the fact that the length of the lever head 230 containing the teeth 224 has not yet been engaged when the lever 212 is in the "positioning" position.

FIGS. 7A to 7C show an operation of the device 200 according to an embodiment. The user may slide the device onto the heel of the shoe with the lever 212 "down" in the "open" position, as shown in FIG. 7A. When the user has the device in the desired position on the heel, the lever 212 is moved "up" into the "positioning" position with the lever head 230 in contact with the material of the heel, as shown in FIG. 7B. To secure the device onto the heel, the user moves the lever 212 all the way "up" until the locking portion 240 on the lever 212 and the locking portion 242 on the latching portion 208 are in contact, as shown in FIG. 7C.

Although the lever 212 has been described as being moved "down" and "up", and being in "down" and "up" positions corresponding to the "open" and "secured" positions, respectively, these positions may be reversed by reversing the orientation of the asymmetrically-shaped lever head 230 such that when the lever is in the "up" position, the device is "open", and when the lever is in the "down" position, the device is "secured."

Figure 8A:
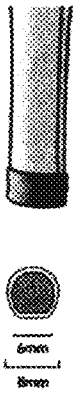
FIGS. 8A to 8C shows a range of widths for various heel styles.
Figure 8B:
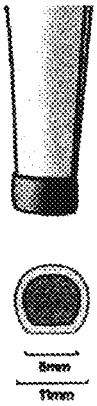
Figure 8C:
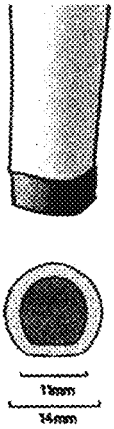

The device 200 may come in various sizes to fit different styles of heels. For example, FIGS. 8A, 8B, and 8C show some popular styles, including "narrow" (6 mm-8 mm), "classic" (8 mm-11 mm), and "wide" (11 mm-14 mm), respectively. In an embodiment, the inner width of device 200 between the two sides 220 may be sized to accommodate a range of heel widths, e.g., 6 mm to 8 mm, in the general category, in this case, "narrow," and larger devices for the other categories.

While the present invention has been described in terms of the foregoing embodiments, those skilled in the art will recognize that the invention is not limited to the embodiments depicted. The present invention may be practiced with modification and alteration within the spirit and scope of the appended claims. Thus, the description is to be regarded as illustrative instead of restrictive on the present invention.

The invention claimed is:

1. A heel protection system, comprising:
a shoe, which comprises a heel; and
a heel protection device, comprising:
an outer portion having a curved shape;
a latching portion having a horizontal axis and a vertical axis; two sides connecting the outer portion and the latching portion;
an inner receptacle formed from the inner surfaces of the outer portion, the sides, and the latching portion, such that the inner receptacle is configured to receive the heel; and
a lever rotatably connected along the horizontal axis of the latching portion, the lever comprising an arm, and a head having a first portion, and a second portion including a plurality of friction elements, wherein the head has an asymmetric shape such that when the arm is in a first position on the vertical axis of the latching portion, the first portion of the head extends a first distance into the inner receptacle,
wherein the inner receptacle extends through an opening between the outer portion, the sides, and the latching portion, such that the heel protection device is configured to be freely moveable onto and along the heel when the arm is in the first position; and
when the arm is in a second position on the vertical axis of the latching portion, the second portion of the head including the friction elements extends a second distance into the inner receptacle, the second distance being greater than the first distance;
such that the heel protection device is configured to be secured in a secured position on the heel when the arm is in the second position;
such that the heel protection device protects a portion of the heel from damage, when the heel protection device is secured in the secured position on the heel.

2. The heel protection system of claim 1, wherein the lever includes a first locking portion and an outer surface of the latching portion includes a second locking portion such that the first and second locking portions are in contact when the arm is in the second position.

3. The heel protection system of claim 1, wherein the outer portion has a first hardness, and further comprising:
a lining layer covering at least a portion of an inner surface of the outer portion, the lining layer having a second hardness, wherein the first hardness is greater than the second hardness.

4. The heel protection system of claim 1, wherein the friction elements are ridge-shaped.

5. The heel protection system apparatus of claim 1, wherein the lever is rotatably attached to the latching portion by a hinge element extending through a portion of the lever between the head of the lever and the arm of the lever.

6. The heel protection system of claim 1, wherein the inner receptacle has a width between the sides in a range of between 8 mm and 14 mm.

7. The heel protection system of claim 1, wherein the inner receptacle has a shape approximating a circumference of the heel of the shoe.

8. A heel protection method, comprising:
a) moving a heel protection device onto a heel of a shoe;
b) securing the heel protection device in a secured position on the heel;
such that the heel protection device protects a portion of the heel from damage;
wherein the heel protection device comprises:
an outer portion having a curved shape;
a latching portion having a horizontal axis and a vertical axis; two sides connecting the outer portion and the latching portion;

an inner receptacle formed from the inner surfaces of the outer portion, the sides, and the latching portion, such that the inner receptacle is configured to receive the heel; and a lever rotatably connected along the horizontal axis of the latching portion, the lever comprising an arm, and a head having a first portion, and a second portion including a plurality of friction elements, wherein the head has an asymmetric shape, such that when the arm is in a first position on the vertical axis of the latching portion, the first portion of the head extends a first distance into the inner receptacle, wherein the inner receptacle extends through an opening between the outer portion, the sides, and the latching portion, such that the heel protection device is configured to be freely moveable onto and along the heel when the arm is in the first position; and when the arm is in a second position on the vertical axis of the latching portion, the second portion of the head including the friction elements extends a second distance into the inner receptacle, the second distance being greater than the first distance;

such that the heel protection device is configured to be secured in a secured position on the heel when the arm is in the second position.

9. The heel protection method of claim 8, wherein the lever includes a first locking portion and an outer surface of the latching portion includes a second locking portion such that the first and second locking portions are in contact when the arm is in the second position.

10. The heel protection method of claim 8, wherein the outer portion has a first hardness, and further comprising:

a lining layer covering at least a portion of an inner surface of the outer portion, the lining layer having a second hardness, wherein the first hardness is greater than the second hardness.

11. The heel protection method of claim 8, wherein the friction elements are ridge-shaped.

12. The heel protection method of claim 8, wherein the lever is rotatably attached to the latching portion by a hinge element extending through a portion of the lever between the head of the lever and the arm of the lever.

13. The heel protection method of claim 8, wherein the inner receptacle has a width between the sides in a range of between 8 mm and 14 mm.

14. The heel protection method of claim 8, wherein the inner receptacle has a shape approximating a circumference of the heel of the shoe.

* * * * *